US005661953A

United States Patent [19]

Jolley

[11] Patent Number: 5,661,953

[45] Date of Patent: Sep. 2, 1997

[54] CHRISTMAS LIGHT WRAPPER AND STORAGE APPARATUS

[76] Inventor: Kathy Marie Jolley, 4409 Sandia Ct., Farmington, N. Mex. 87401

[21] Appl. No.: 494,708

[22] Filed: Jun. 26, 1995

[51] Int. Cl.[6] ..... B65B 63/04; B65B 67/00

[52] U.S. Cl. ..... 53/430; 53/116; 53/390

[58] Field of Search ..... 53/397, 430, 116, 53/580, 581, 390

[56] References Cited

U.S. PATENT DOCUMENTS

| | | | |
|---|---|---|---|
| D. 339,976 | 10/1993 | Ferguson, Sr. | D8/359 |
| 3,690,087 | 9/1972 | Jacobsen | 53/430 X |
| 3,882,658 | 5/1975 | Cleary | 53/116 |
| 3,931,887 | 1/1976 | Beck | 206/419 |
| 4,917,323 | 4/1990 | Wing | 242/96 |
| 5,064,067 | 11/1991 | McAllister | 206/420 |
| 5,168,999 | 12/1992 | Lee et al. | 206/420 |
| 5,287,965 | 2/1994 | Miller | 206/396 |
| 5,381,899 | 1/1995 | Rabbit | 206/397 |

*Primary Examiner*—Linda Johnson
*Attorney, Agent, or Firm*—Dennis F. Armijo

[57] ABSTRACT

A Christmas light wrapping apparatus comprising wrapping trays with indentations for keeping the light strings separated and a base with a crankshaft for turning the trays, thereby winding the Christmas light strings. Additionally, a storage structure protects wrapped Christmas light strings and accommodates the wrapping trays.

12 Claims, 2 Drawing Sheets

CHRISTMAS LIGHT WRAPPER AND STORAGE APPARATUS

BACKGROUND OF THE INVENTION

1. Field of the Invention (Technical Field)

The invention relates to an apparatus for storage of Christmas lights.

2. Background Art

Every year, many people perform the tedious task of untangling strings of Christmas lights and, once the season is over, attempt to roll or package the strings so they will untangle easily and keep the fragile bulbs from breaking. Variations upon these devices and methods proliferate in the prior art.

U.S. Pat. No. 5,064,067, to McCallister, et al., discloses a frame like device with a plurality of tapered tooth-like projections for wedging the light cord within the formed "V's". This system accommodates only certain sized cords and can accommodate only a limited length of string or strings which is dependent on the number of formed "V's". In addition the device fails to disclose a safe storage device to avoid bulb breakage.

U.S. Pat. No. 5,168,999, to Lee, et al., and U.S. Pat. No. 5,381,899, to Rabbitt, describe a light packaging device for viewing, testing and eventual retail sale of light strings. Although the specification in Lee, et al., indicates the device is for storage of lights, the repackaging of Christmas lights in the device is extremely complex and time consuming. In addition, the devices are designed to hold only one string of lights.

U.S. Pat. No. 5,287,965, to Miller, discloses a cardboard core around which Christmas lights are wrapped. The device does not have a notch for holding the beginning or end of the string and is designed for only one light string.

U.S. Pat. No. Design 339,976 to Ferguson, Sr., discloses a a combined reel and cover with a crank for storage of Christmas lights. The device appears bulky and expensive to manufacture and fails to keep different light strings separated.

U.S. Pat. No. 4,917,323 to Wing, discloses a cylindrical device with several circular crowns with slits for inserting separate light bulbs of a Christmas light string. This device suffers due to its complexity and is very time consuming to use.

The shortcomings of these prior art devices are overcome by the present invention.

SUMMARY OF THE INVENTION (DISCLOSURE OF THE INVENTION)

In accordance with the present invention there is provided an apparatus and method for wrapping and storing light strings. The preferred apparatus of the invention is a light string storage tray for more than one light string comprising a substantially flat member, at least one indentation on the flat member for wrapping an individual light string, and at least one slot disposed on the flat member for receiving an end of the light string. The preferred at least one indentation comprises a depth greater than a thickness of a wrapped light string. The preferred at least one slot is disposed on the at least one indentation. The at least one slot can be disposed on each end of the at least one indentation.

The preferred light string storage and winding apparatus comprises a wrapping tray comprising a substantially flat member, and at least one slot on the flat member for receiving an end of a light string, and a wrapping tray spinning apparatus for winding the light string around the wrapping tray. The preferred wrapping tray further comprises at least one indentation for wrapping a light string. The preferred at least one indentation comprises a depth greater than a thickness of a wrapped light string.

The preferred wrapping tray spinning apparatus comprises a crankshaft, a crankshaft turning structure, and a wrapping tray securing apparatus for affixing the wrapping tray to the wrapping tray spinning apparatus. The preferred crankshaft turning structure comprises a handle. The crankshaft turning structure can also comprise a motor. The preferred crankshaft further comprises a drive pin.

The preferred wrapping tray securing apparatus comprises a first aperture in the wrapping tray for inserting the crankshaft, and a second aperture for inserting a grip knob shaft. The preferred grip knob shaft comprises an apparatus for placing tension on the wrapping tray.

The invention further comprises a storage box for storing wrapping trays. The preferred wrapping tray storage box comprises support members for supporting at least one wrapping tray.

The preferred method for wrapping a string of lights around a tray comprises the steps of providing a wrapping tray, inserting an end of a string of lights into a slot in the wrapping tray, and providing a tray spinning apparatus for wrapping the string of lights around the wrapping tray. The preferred step of providing a tray spinning apparatus comprises inserting a crankshaft into the wrapping tray, securing the wrapping tray to the crankshaft with tension, and turning the crankshaft.

A primary object of the invention is the provision of a light string wrapping and storage apparatus.

Another object of the invention is the provision of a wrapping tray for storage of one or more individual light strings.

Another object of the invention is to protect the light bulbs of the light string while in storage.

Yet another object of the invention is the provision of a spinning wrapping apparatus for the wrapping trays.

The primary advantage of the present invention is its ease of use and low cost.

Another advantage of the invention is that it keeps individual light strings separated.

Yet another advantage is that several wrapping trays can be stored in a safe and compact box.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

Several devices and systems he been utilized to wrap and store Christmas lights. Proper wrapping and storage facilitates reuse of the light strings and keeps the fragile bulbs from breaking during storage.

Figure 1:
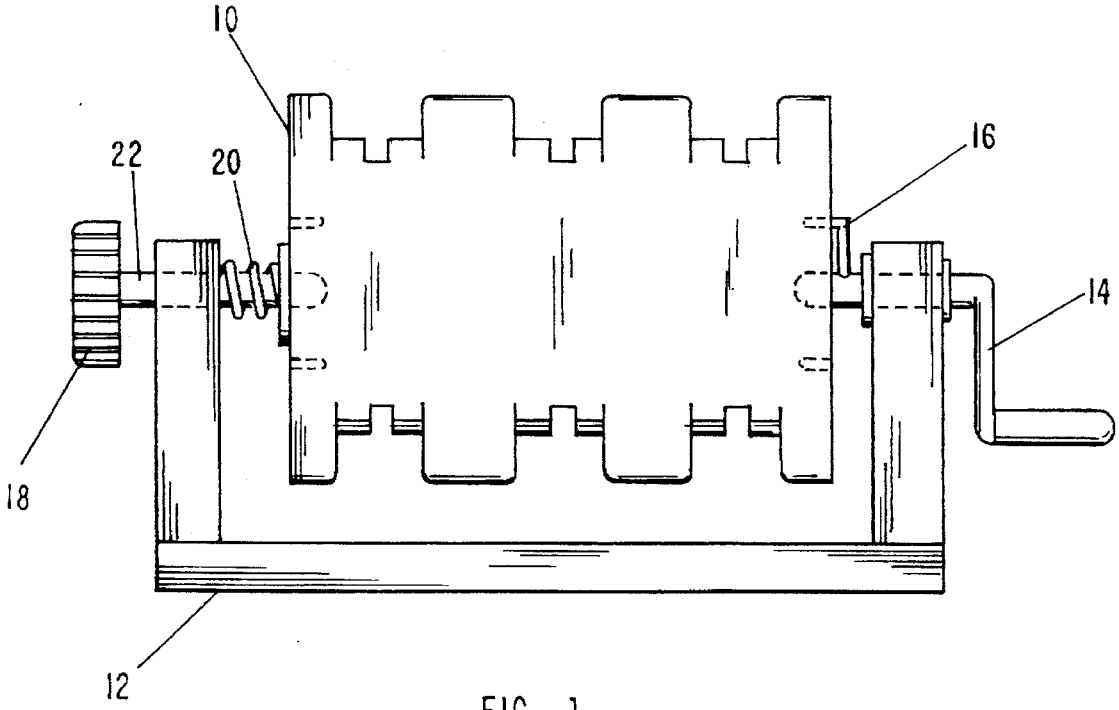
FIG. 1 is a front view of the preferred Christmas light wrapping apparatus of the present invention.

FIG. 1 depicts the preferred Christmas light wrapper of the preferred invention. Wrapping tray 10 is removably attached to base 12 as shown. Crankshaft 14 is inserted into one end of wrapping tray 10 along with driver pin 16. Grip knob 18 with grip knob shaft 22 is pulled back and then inserted into the other end of wrapping tray 10. Tension is placed on wrapping tray 10 to keep it snug on crank shaft 14 and drive pin 16 by spring 20, or the like. Although a spring is shown in FIG. 1, this disclosure is intended to include other tension supplying apparatuses such as leaf springs, threads on grip knob shaft 22 and other well known methods in the art (not shown). In addition, more than one drive pin can be utilized (not shown).

Figure 2:
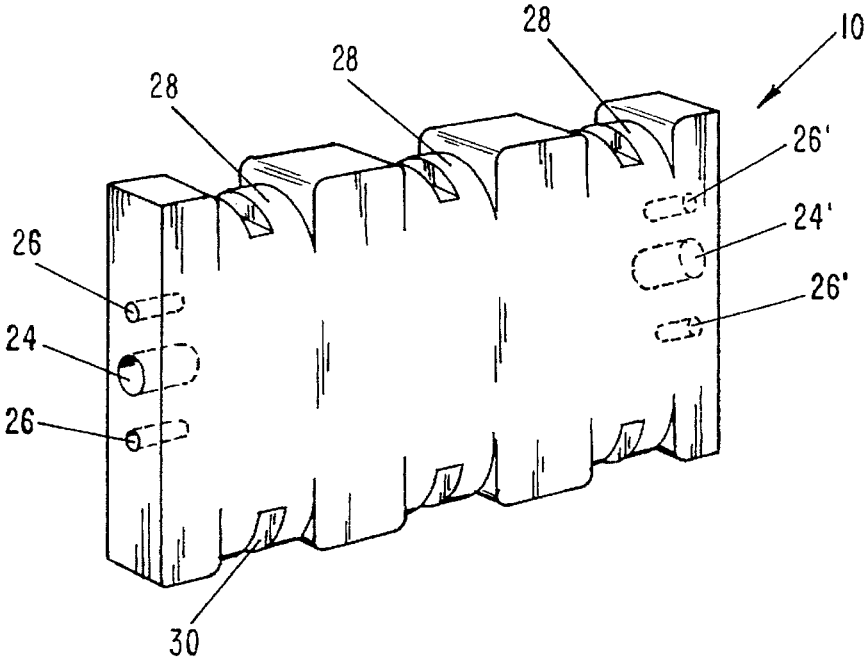
FIG. 2 depicts the preferred wrapping tray.

The preferred wrapping tray is shown in FIG. 2. Each wrapping tray 10 is made for easy installation and removal from the base. In addition, each can be constructed for easy and inexpensive manufacture from a variety of plastics, metals, wood, or the like. Each tray has mirror image holes 24, 24', 26 and 26' on each side. Center hole 24 and 24' accommodates either crank shaft 14 or grip knob shaft 22 of FIG. 1. Drive pin holes 26 and 26' are formed or drilled as shown. In this fashion, wrapping tray 10 can be mounted on the base 12 without having to line up the correct ends or orientation. Wrapping tray 10 can have indented sections 28 for keeping each string of lights separate from others and to keep bulbs from breaking when placed in storage, as further described below. Although three indented sections 28 are depicted, each wrapping tray 10 can have fewer or more indented sections 28. Slots 30 can be provided for inserting one or both ends of the Christmas light strings.

Figure 3:
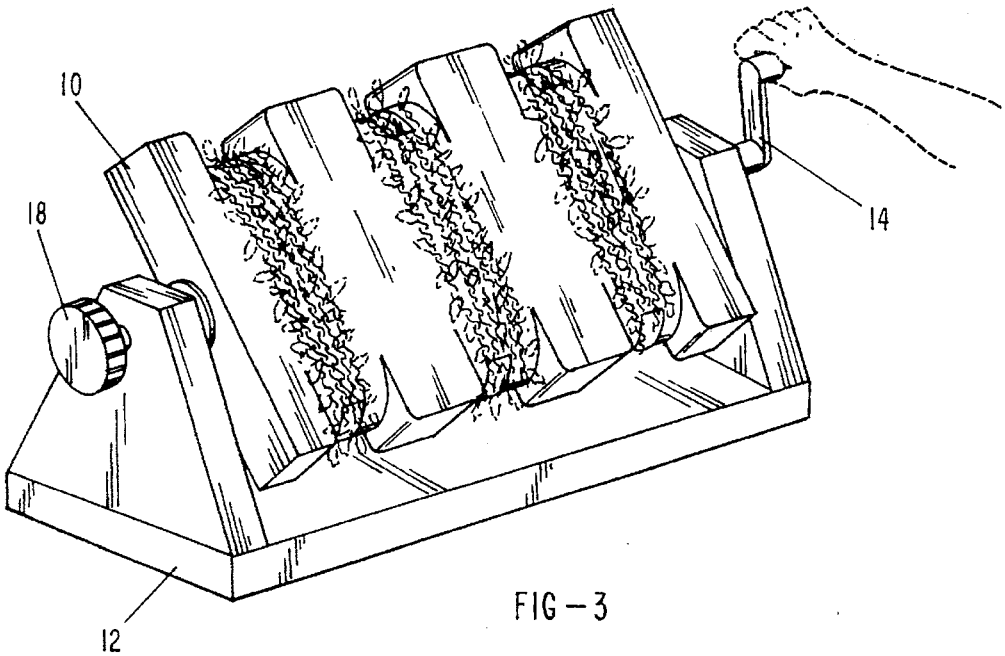
FIG. 3 shows the preferred Christmas light wrapping apparatus in operation.

To utilize the preferred Christmas light wrapper, wrapper tray 10 is mounted onto base 12 by guiding center hole 24 and driver pin hole 26 over crankshaft 14 and driver pin 16, as shown in FIG. 3. Grip knob 18 is pulled back and wrapper tray 10 is placed so center hole 24' is aligned with grip knob shaft, and grip knob 18 is released with tension from spring 20 keeping wrapper tray 10 in place. One end of a string of Christmas lights is wedged into slot 30. Crank 32 is turned in either a clockwise or counterclockwise direction until the entire light string is wrapped around wrapper tray 10. In addition to manually turning crankshaft 14, it can be turned with a motor, an electric drill or the like (not shown). Once the first string is wrapped, a second light string can be started on a next indented section 28, and the process repeated until all indented sections 28 are utilized or all light strings are wrapped. Once the wrapper tray 10 is full or contains as many light strings as the user desires, another wrapper tray can be mounted onto base 12 for use.

Figure 4:
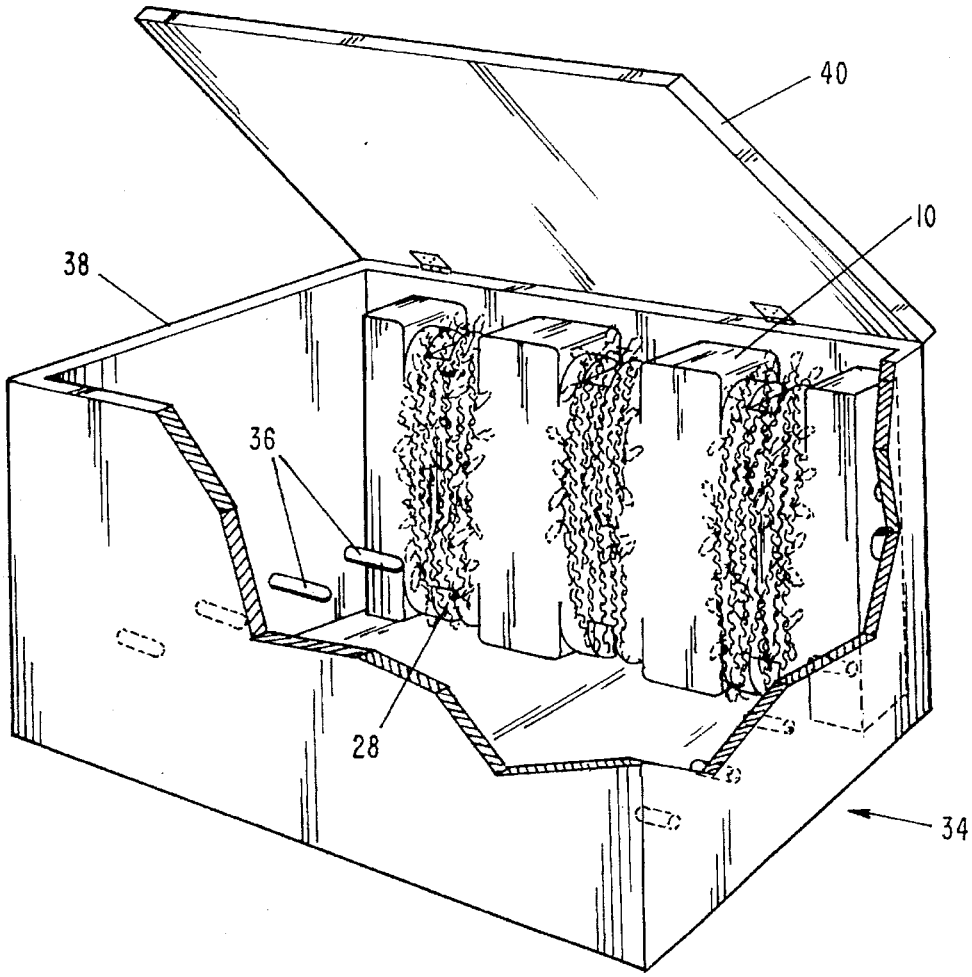
FIG. 4 is a perspective view of he preferred storage box.

The preferred storage box for wrapper trays 10 is shown in FIG. 4. Storage box 34 can be fabricated from the same materials as wrapper trays 10. Each storage box 34 is constructed to enclose one or more wrapper trays to keep items from breaking the light bulbs and getting entangled with the wires and also to keep each of the wrapper trays 10 separated while in storage. As previously described, each wrapper tray 10 has indented sections 28 for keeping light strings separated. Each indented section 28 should have an indentation sufficiently deep so that when wrapper tray 10 is placed inside of storage box 34, the light bulbs do not absorb the weight of wrapper tray 10, no matter what direction storage box 34 is set. Dividers 36 keep each wrapper tray 10 separated. Dividers 36 can be dowel pins, "L" brackets or other well known apparatuses in the art. Sides 38 of storage box 34 should be of sufficient height to cover the wrapper trays 10. In addition, a top 40 can be provide to fully enclose the wrapper trays 10.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, are hereby incorporated by reference.

What is claimed is:

1. A light string storage and winding apparatus comprising:

a wrapping tray comprising:

a substantially flat member, thinner in one dimension than in another;

at least one slot on said flat member for receiving an end of at least one light string;

a plurality of compartments for containing the at least one light string; and a wrapping tray spinning means for winding the at least one light string around at least one wrapping tray.

2. The invention of claim 1 wherein each of said plurality of compartments comprise a depth greater than a thickness of a wrapped at least one light string.

3. The invention of claim 1 wherein said wrapping tray spinning means comprises:

a crankshaft;

a crankshaft turning means; and a wrapping tray securing means for affixing said at least one wrapping tray to said wrapping tray spinning means.

4. The invention of claim 3 wherein said crankshaft turning means comprises a handle.

5. The invention of claim 3 wherein said crankshaft turning means comprises a motor.

6. The invention of claim 3 wherein said crankshaft further comprises a drive pin.

7. The invention of claim 3 wherein said wrapping tray securing means comprises:

a first aperture in said at least one wrapping tray for inserting said crankshaft; and a second aperture for inserting a grip knob shaft.

8. The invention of claim 7 wherein said grip knob shaft comprises tension on said at least one wrapping tray.

9. The invention of claim 1 further comprises a storage box for said at least one wrapping tray.

10. The invention of claim 9 wherein said storage box comprises support members for supporting said at least one wrapping tray.

11. A method for wrapping at least one string of lights around a tray, the method comprising the steps of:

a) providing a wrapping tray comprising a substantially flat member with sides thinner than a front and a back;

b) inserting an end of at least one string of lights into at least one slot in the wrapping tray;

c) providing a plurality of compartments for the at least one string of lights; and d) spinning the wrapping tray whereby the at least one string of lights is wrapped around the wrapping tray within one of the plurality of compartments.

12. The method of claim 11 wherein the step of spinning the wrapping tray comprises:

a) inserting a crankshaft into the wrapping tray;

b) securing the wrapping tray to the crankshaft with tension; and c) turning the crankshaft.

* * * * *